United States Patent [19]

Gwilliam, Jr. et al.

[11] 3,989,142

[45] Nov. 2, 1976

[54] STACKABLE CONTAINER LID

[75] Inventors: James L. Gwilliam, Jr.; Warde Mitchell Cameron, Jr., both of Salt Lake City, Utah

[73] Assignee: Plastronics Corporation, West Jordan, Utah

[22] Filed: Oct. 15, 1975

[21] Appl. No.: 622,659

[52] U.S. Cl. ..... 206/508; 206/509; 220/306; 220/374; 220/380

[51] Int. Cl.² ..... B65D 21/02; B65D 43/10; B65D 51/16

[58] Field of Search ..... 206/508, 509, 510, 511; 220/306, 367, 374, 380

[56] References Cited

UNITED STATES PATENTS

| | | | |
|---|---|---|---|
| 2,822,952 | 2/1958 | Scott | 206/511 |
| 3,061,139 | 10/1962 | Edwards | 220/380 |
| 3,070,257 | 12/1962 | Bojanowski | 206/508 |
| 3,362,575 | 1/1968 | Fotos | 206/508 |
| 3,369,687 | 2/1968 | Walls | 206/508 |
| 3,409,123 | 11/1968 | McCormick | 220/306 |
| 3,627,170 | 12/1971 | Pullman | 220/306 |
| 3,679,088 | 7/1972 | Swett | 220/306 |
| 3,858,756 | 1/1975 | Fulton | 220/306 |

FOREIGN PATENTS OR APPLICATIONS

| | | | |
|---|---|---|---|
| 1,231,761 | 4/1960 | France | 206/508 |

*Primary Examiner*—George E. Lowrance
*Attorney, Agent, or Firm*—Criddle, Thorpe & Western

[57] ABSTRACT

A stackable container lid for a bucket containing hot foods and the like comprising a generally circular lid having center portion surrounded by a series of polyhedrons, one plane of which extends upwardly at right angles from the lid surface thereby forming a perimeter into which the bottom of the bucket can be inserted. The lid may also contain vent holes in a rim on the outer perimeter of the container lid. The rim terminates in a downwardly extending lip adapted to snap over the top of the bucket in a sealing relationship.

10 Claims, 3 Drawing Figures

STACKABLE CONTAINER LID

BACKGROUND OF THE INVENTION

This invention relates to lids for packaging containers. More particularly, this invention relates to lids for packaging containers holding hot foods and the like wherein the lid is so designed as to receive the base of the container thus allowing for the stacking of one container upon another.

It is common to package cooked carryout food items such as fried chicken or fish and chips in cartons or buckets made of low-cost materials such as cardboard or plastic. Such containers are generally cylindrical in shape flaring outwardly such that the circumference at the base is less than the circumference at the top of the container. Such a design, while sufficient for food holding purposes, often presents problems in storage and handling. For example, in many instances it would be desirable to stack one container on another. In the absence of an appropriately designed lid the containers having a smaller circumference at the base than at the top and having the lid thereon, will not stack neatly, but will slide across the top of the lid. Another disadvantage is that the base of such barrels or buckets is sufficiently small that when picnicking or in a like situation, a breeze or slight wind can cause the bucket to tip over thereby spilling the contents contained therein.

BRIEF DESCRIPTION AND OBJECTS OF THE INVENTION

It is an object of the present invention to provide a semiflexible lid that will promote the stacking or freestanding of containers containing hot foods and the like.

It is a further object of the present invention to provide a container lid, which, when fastened to the container will allow for the stacking of containers of like size whereby the lid grasps the bottom of the container inserted therein more tightly as the downward pressure on the lid is increased.

It is a still further object of the present invention to provide a freestanding base for a container which also serves as a lid for the same container such that when the lid is removed from the container it can be inserted into the container base thereby inhibiting the tendency of the container to tip as a result of an externally applied force.

These and other objects may be accomplished by the invention as hereinafter described. Principal features of the invention include a generally circular lid adapted to fit over a relatively large container made of low-cost, durable materials, such as plastic or cardboard, which is shaped to provide an ascetically pleasing appearance and has an upper, outwardly turned or rolled lip type rim. The container has a top circumference which is larger than the circumference of the container at the base. Such tub-like containers are commonly used in the carryout food business. The lid which forms the novel part of this invention is generally circular in shape and has a circular inner portion having the same circumference as the bottom of the container for which it is designed to fit. Surrounding the central circular portion is a continuous series of polyhedrons. Each polyhedron consists of an upwardly projecting triangular inner surface and an inwardly projecting inclined rectangular upper surface, the points of the two triangular surfaces meeting to form an apex. The sidewalls of each polyhedron slope outwardly and downwardly from the edges of the upper triangular surface which depend from the apex and extend outwardly and backwardly from the edges of the upwardly projecting triangular surface which depend from the apex. Such sidewalls of one polyhedron will adjoin the sidewalls of an adjacent polyhedron at the bottom edge thereof to form a valley, which valley will extend from the perimeter of the inner, upwardly projecting, triangular surfaces surrounding the circular center to a backwall portion, which backwall portion is defined as the space between the sloping adjoining sidewalls. The backwall portion is contiguous with the back edges of the irregular rectangle forming the sloping sidewalls. The back edge of the upper triangular surface of the polyhedron and the top edge of the backwall portion, which terminates the valleys, are bounded by a contiguous border adapted to rest on the rim of the container over which the lid is to fit. These may be contained in the border, various vents to allow the escape of moisture from hot steamed food placed in the container. The lid is completed by a downwardly extending lip which is integral with the above mentioned border. Said lip is sufficiently flexible to extend over the rolled rim of the container and then be held against the rim of said container in a sealing relationship.

Preferably, the circular center portion of the lid is slightly convex and is of the same circumference as the bottom of the container. When the lid is placed on a container and another container is stacked thereon, the base of the container fits within the central portion of the lid and is frictionally held in place by the inner surfaces of the polyhedrons. As the weight of the container resting on the lid presses downwardly, the apex of each polyhedron is drawn inwardly against the stacked container holding it even more firmly in place. Likewise, the same results are obtained when not used in a stacking relationship, but when the lid is removed from a container and utilized as a base therefor. The more weight that is placed in the container, the tighter the polyhedrons will grip the container base.

The novel features of this invention both as to the manner of construction and usage will be better understood with reference to the following detailed description and drawings. It is to be understood, however, that the descriptions and drawings are for the purpose of illustration only and not intended to be a definition as to the scope of the invention.

DRAWINGS OF THE INVENTION

DETAILED DESCRIPTION OF THE DRAWINGS

Figure 1:
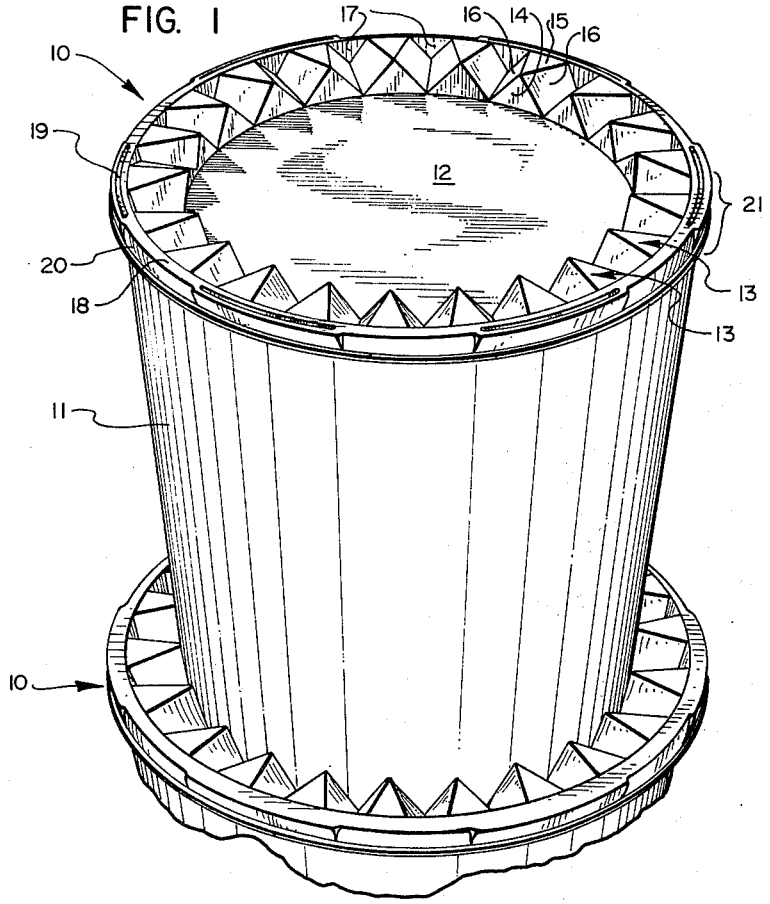
FIG. 1 is a perspective view of a container having inserted thereon the lid of the present invention, said container being stacked upon another container partially shown also containing a lid according to the present invention.
Figure 2:
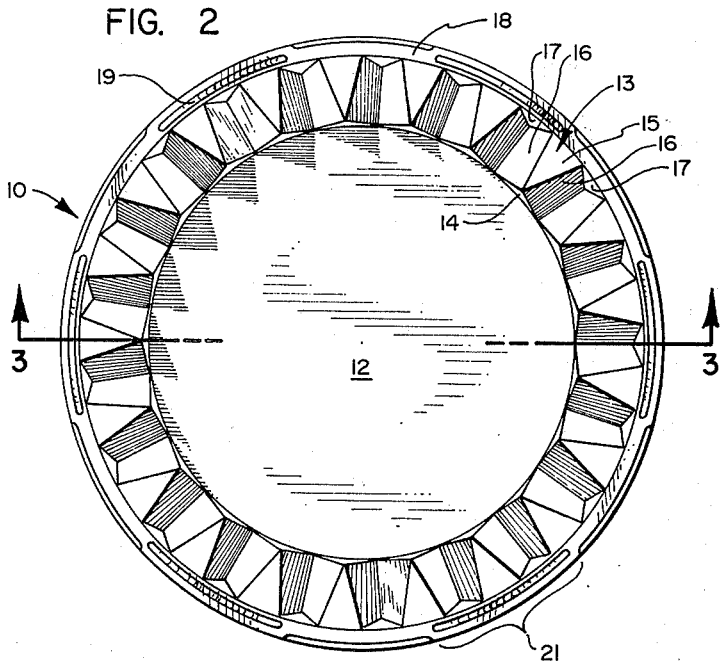
FIG. 2 is a top elevation view of the lid according to the present invention.
Figure 3:
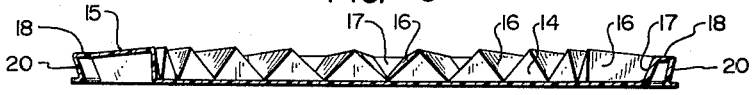
FIG. 3 is a cross sectional view of the lid of the present invention taken along line 3—3 of FIG. 2.

The preferred operative embodiment of the invention is illustrated in FIGS. 1–3 and consists of a lid 10 adapted to fit over a container 11. Container 11 consists of a tub-like container usually used for carryout foods such as fried chicken, fish and chips, fried prawns and the like. The container is made from inexpensive materials such as cardboard or plastic and has a rolled formed rim at the top and is larger in circumference at the top than at the base.

Lid 10 is generally circular in shape and has a circular center portion 12 which may be flat or slightly convex, being higher in the center than at the periphery. As shown in the FIGS. there surrounds the periphery of central portion 12, a continuous series of polyhedrons 13 having two plane faces, the sidewalls of which are equal. Each polyhedron 13 is an integral part of the lid and consists of a triangular vertical inner surface having its base along the periphery of center portion 12. Inner surface 14 terminates at the top in a vertical point. Inner surface 14 is slightly arcuate so as to follow the circular periphery of the center portion 12. The upper surface 15 of polyhedron 13 is also triangular in shape and extends inwardly and at a slight incline toward the point of inner surface 14. The triangular points of inner surface 14 and upper surface 15 meets at a common point forming an apex. The sidewalls of polyhedron 13 are equal in size and, beginning at the apex, extend outwardly and downwardly from the edges of the upper triangular surface and, again beginning at the apex, extend outwardly and backwardly from the edges of the inner triangular surface. Thus each sidewall 16 forms an irregular rectangle, the topside being integral with a side edge of upper surface 15, the forward side being integral with a side edge of inner surface 14, the bottom edges being integral with the bottom edge of an adjacent polyhedron and the backside being integral with a backwall portion 17. It is apparent that the point of juncture of the bottom edges of adjacent sidewalls 16 will form a valley 18 extending from the periphery of the central portion 12 to backwall portion 17. The valley 18, because of the triangular shape of upper surface 15, will be wider at the mouth extending from the apex of one polyhedron to the adjacent polyhedron at the top, than at the back where it extends from the angle at the base of one triangular surface 15 to the closest angle at the base of an adjacent triangular surface 15. Backwall 17 is defined by the triangular space between adjacent top triangular surfaces 15 and the adjacent sloping sidewalls 16 and is integral therewith. Contiguous with and circumventing the base of triangular surfaces 15 and the top of backwall 17 is a border 19 which is adapted to fit over the rim of container. If desired, to allow the escape of steam or other gases from within container 11, the border 19 will contain vents 20. The lid terminates in a circular, downwardly, inwardly extending lip depending from the outer portion of border 19 which is adapted to fit over the rim of the container 11 and secure the lid 10 in a sealed relationship thereto. If desired, the downwardly depending lip 21 may contain a relatively short arcuate projection 22 at substantially right angles from the lip bottom to serve as a handle when removing lid 10 from container 11.

The lid may be made from any semirigid material and is preferably a thermoformed plastic.

As will be apparent from the description and the drawings, the lid 10 serves two primary functions other than as a lid or cover. When used separately, the lid can be removed from the container 11 and placed around the base of the container as illustrated in FIG. 1 as a base to keep the container from tipping. In the alternative, as also illustrated in FIG. 1, the lids allow the stacking of one container on another. The circumference of the base container 11 is the same as the periphery of the central portion 12 of the lid. The downward pressure created by the weight of the container causes the polyhedrons to extend inwardly, especially at the apex, to frictionally grip the container base. This action is accentuated when the central lid portion 12 is slightly convex.

Although the invention as has been described is deemed to be that which would form the preferred embodiment of the invention, it is recognized that departures may be made therefrom without departing from the scope of the invention which is not to be limited to the details disclosed, but is to be accorded the full scope of the claims so as to include any and all equivalent closures.

What is claimed is:

1. A semiflexible container lid comprising a generally circular lid having a circular center portion surrounded by a continuous series of polyhedrons, each consisting of an upwardly projecting arcuate triangular inner surface and an inwardly projecting inclined triangular upper surface, the points of juncture of said triangular surfaces forming an apex, the sidewalls of each polyhedron sloping outwardly and away from the edges of the triangular surfaces depending from the apex to form an irregular rectangle, each sidewall adjoining the sidewall of an adjacent polyhedron at the bottom edge thereof to form a valley which valley extends from the perimeter of the circular center portion to a backwall portion defined by the space between the sloping adjoining sidewalls, said backwall portion being contiguous with the back edges of said sloping sidewalls, the back edge of said upper triangular surface and the top edge of said backwall portion being bounded on the outside by a contiguous border adapted to rest on the rim of a container, said border terminating in a downwardly and inwardly extending lip which is sufficiently flexible to expand over the rim of a container in a sealing relationship.

2. A container lid as claimed in claim 1 wherein the polyhedrons are adapted to press inwardly when pressure is placed on the circular center portion of the lid.

3. A container lid as claimed in claim 2 wherein the border adapted to rest on the rim of a container contains vents.

4. A container lid as claimed in claim 3 wherein the downwardly extending lip contains handle means extending therefrom at right angles.

5. A container lid as claimed in claim 4 wherein the circular center portion is slightly convex.

6. A container and lid combination comprising a. a container having a rim at the top and having a closed bottom, the circumference of the container being greater at the top than at the base, and b. a lid adapted to fit on to the base of said container or to fit over the top of said container in a sealing relationship, said lid containing a circular center portion surrounded by a continuous series of polyhedrons, each consisting of an upwardly projecting arcuate triangular inner surface and an inwardly projecting inclined triangular upper surface, the points of juncture of said triangular surfaces forming an apex, the sidewalls of each polyhedron sloping outwardly and away from the edges of the triangular surfaces depending from the apex to form an irregular rectangle, each sidewall adjoining the sidewall of an adjacent polyhedron at the bottom edge thereof to form a valley, which valley extends from the perimeter of the circular center portion to a backwall portion defined by the space between the sloping adjoining sidewalls, said backwall portion being contiguous with the back edges of said sloping sidewalls, the back edge of said upper triangular surface and the top edge of said backwall portion being bounded on the outside by a contiguous border adapted to rest on the rim of the container, said border terminating in a downwardly and inwardly extending lip which is sufficiently flexible to expand over the rim of the container in a sealing relationship.

7. A container and lid as claimed in claim 6 wherein the periphery of the circular center portion is the same as the circumference of the container base.

8. A container and lid as claimed in claim 7 wherein the polyhedrons in the lid are adapted to press inwardly when pressure exerted by the base of the container is placed on the circular center portion of the lid.

9. A container and lid as claimed in claim 8 wherein the circular center portion of the lid is slightly convex.

10. A container and lid as claimed in claim 9 wherein the border in the lid adapted to rest on the rim of the container contains vents.

* * * * *